US006477755B2

(12) United States Patent
Han

(10) Patent No.: US 6,477,755 B2
(45) Date of Patent: Nov. 12, 2002

(54) GEAR BURNISHING SYSTEM HAVING PRE-CHECKING STATION

(76) Inventor: Sil Han, 321 Sunset Dr., Wilmette, IL (US) 60091

( * ) Notice: Subject to any disclaimer, the term of this patent is extended or adjusted under 35 U.S.C. 154(b) by 0 days.

(21) Appl. No.: 09/854,068

(22) Filed: May 9, 2001

(65) Prior Publication Data

US 2002/0007541 A1 Jan. 24, 2002

Related U.S. Application Data

(60) Provisional application No. 60/203,420, filed on May 10, 2000.

(51) Int. Cl.[7] ..... B24B 39/00
(52) U.S. Cl. ..... 29/90.6
(58) Field of Search ..... 29/90.1–90.6

(56) References Cited

U.S. PATENT DOCUMENTS 4,305,190 A * 12/1981 Flair ..... 29/90.6

* cited by examiner

*Primary Examiner*—P. W. Echols
(74) *Attorney, Agent, or Firm*—Leighton K. Chong

(57) ABSTRACT

A gear burnishing system has a pre-checking station for determining an amount of burnishing processing needed by the gear to be burnished, and a gear burnishing station for performing the burnishing operation on the gear according to parameters set by the pre-checking station. In a preferred embodiment, the pre-checking station determines the condition of the gear within one of a plurality of pre-set ranges for the burnishing operation. In this manner, appropriate gear burnishing parameters can be applied depending on the actual condition of the gear.

5 Claims, 3 Drawing Sheets

GEAR BURNISHING SYSTEM HAVING PRE-CHECKING STATION

This U.S. patent application claims the priority of U.S. Provisional Application No. 60/203,420 of the same inventor filed on May 10, 2000.

TECHNICAL FIELD

This invention generally relates to the burnishing of gears, and particularly, to a system for pre-checking the gear at a pre-checking station.

BACKGROUND OF INVENTION

The conventional method of burnishing gears involves processing gears in a burnishing machine which subjects each gear to the same cycle time, burnishing pressure, and processing steps. The processing cycle is set to handle the expected nicked and deteriorated condition of gears after a certain period of use. If a gear is in relatively good condition, it may not need to be processed in a full burnishing cycle, therefore the burnishing machine performs the operation with unneeded time and extra work load. This also causes the relatively good gear to be subjected to unnecessary burnishing, thereby wearing it down unnecessarily and taking up additional maintenance time.

SUMMARY OF INVENTION

The present invention seeks to solve the problems of the conventional burnishing system by providing a system that will avoid unnecessary burnishing of a gear by pre-checking the condition of the gear before processing.

In accordance with the invention, a gear burnishing system comprises:

(a) a pre-checking station for determining the condition of a gear to be burnished, and providing gear burnishing data representing an amount of burnishing processing needed by the gear in accordance with the determination of the pre-checking station;

(b) a gear burnishing station for receiving the gear and performing a burnishing operation thereon to remove nicks and restore it from deterioration, said gear burnishing station receiving the gear burnishing data and setting parameters for the burnishing operation in accordance therewith.

In a preferred embodiment, the pre-checking station determines the condition of the gear and outputs gear burnishing parameters in one of a plurality of pre-set ranges that the gear condition falls in. In this manner, appropriate gear burnishing parameters can be applied from a limited set of ranges to be carried out by the gear burnishing station.

Other objects, features, and advantages of the present invention will be explained in the following detailed description of the invention having reference to the appended drawings.

DETAILED DESCRIPTION OF INVENTION

Figure 1:
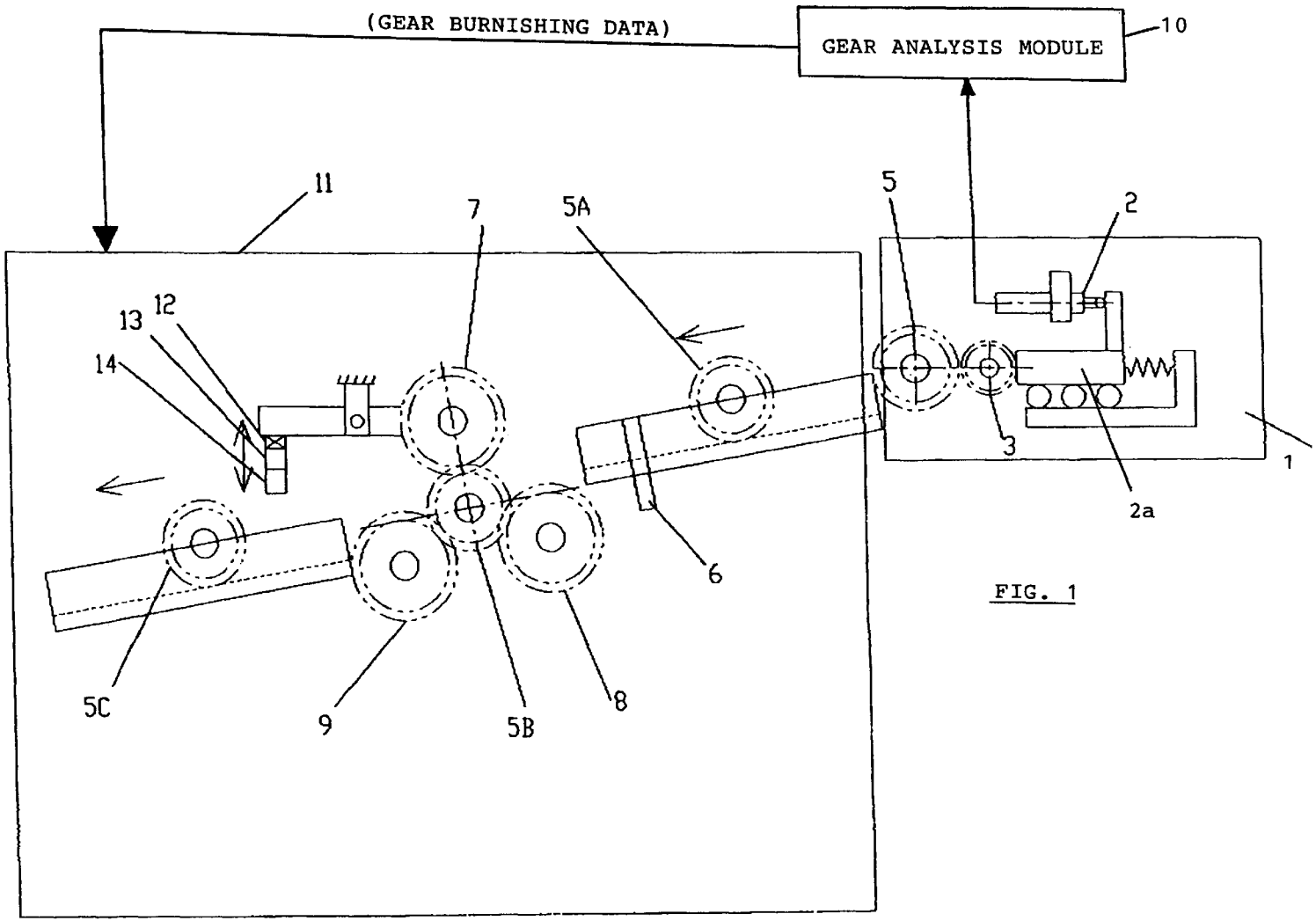
FIG. 1 is a schematic diagram of a gear burnishing system having a pre-checking station in accordance with the invention.

Referring to FIG. 1, a gear burnishing system in accordance with the present invention has a gear pre-checking station 1 and a gear burnishing station 11. The pre-checking station 1 has a precision sensor 2 coupled to a spring-biased armature 2*a* in contact with a master gear 3 which turns in engagement with a gear 5 to be burnished. As the two gears turn, nicks in the surface of the gear 5 will cause slight deflections of the master gear 3 which are detected by the sensor 2. The sensor detection output is sent to the gear analysis module 10 which determines the amount of burnishing processing required by the gear 5 and outputs the appropriate gear burnishing data to the gear burnishing station 11.

The sensor output includes detection of nicks and other physical deterioration conditions in the surface of the gear. For a gear in relatively good condition, the detection data will indicate relatively small nicks and benign deterioration conditions, whereas for a gear in bad condition, the detection data will reflect large nicks and severe deterioration conditions. The detection data is processed by the gear analysis module to determine the appropriate level of gear burnishing operation required to restore the gear (described further herein).

The gear burnishing station has a gate 6 to pass the prechecked gear Sa to the burnishing area formed by a driver burnishing gear 7 and two holder burnishing gears 8 and 9. The driver gear is displaceable to allow the gear to be burnished 5*a* to pass to the burnishing area. The driver gear 7 is then engaged in contact with the gear 5*b* in the burnishing area and applies a burnishing pressure P for a determined processing time T to the gear 5*b* in accordance with the gear burnishing data output by the gear analysis module 10. The burnishing pressure is controlled through a lever force applied to the armature for the drive gear 7 by a linear drive motor 14, lead screw 13, and compression spring 12. The processed gear 5*c* is then discharged from the gear burnishing station.

Figure 2B:
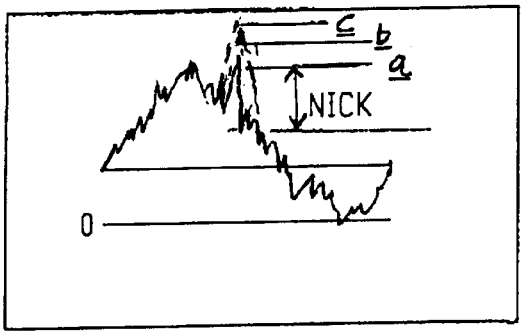
FIG. 2B illustrates comparative detection of nicks on the gear.
Figure 2A:
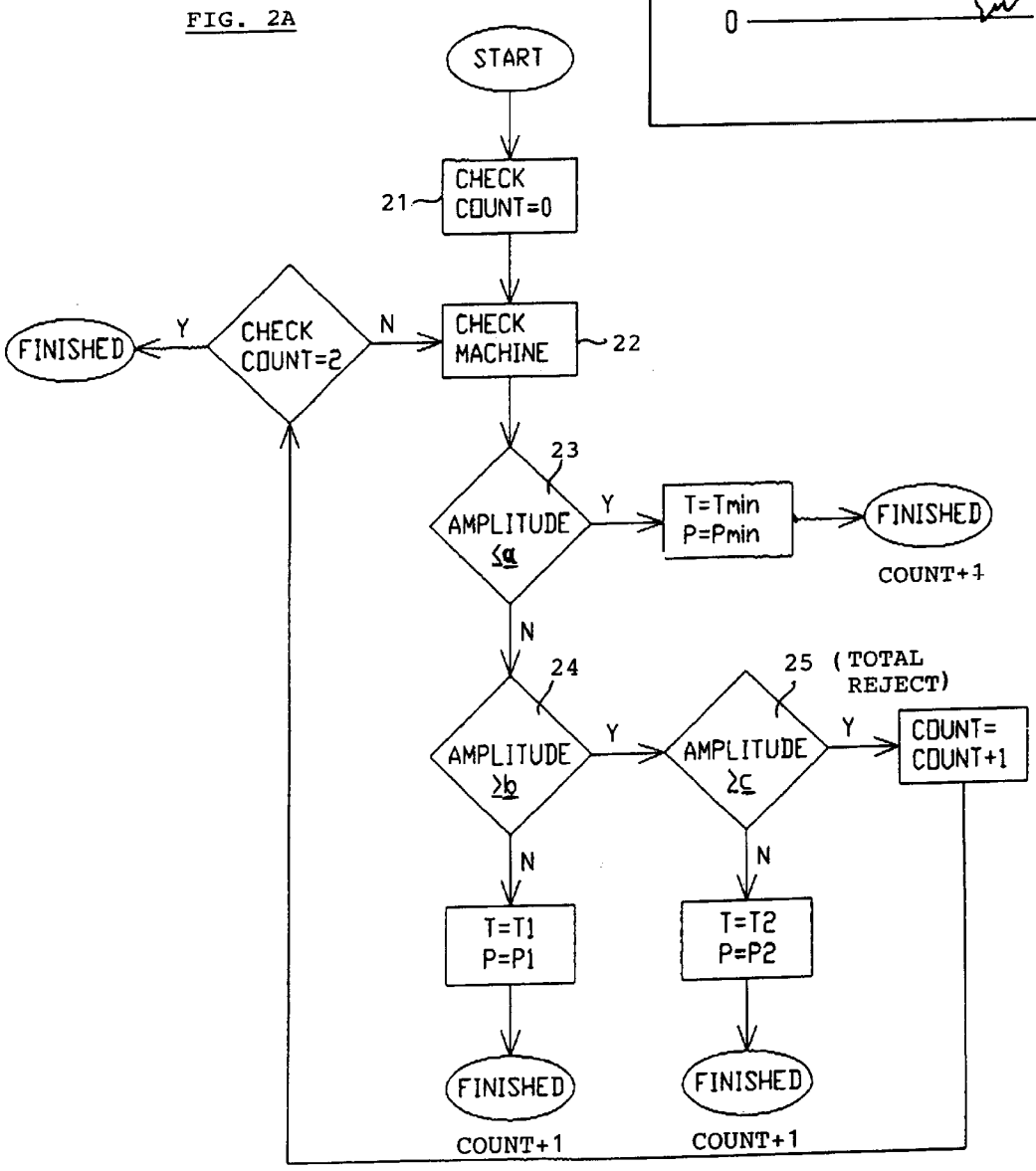
FIG. 2A is a flow chart illustrating a processing program for determining gear burnishing parameters to be applied to a gear.

FIG. 2A is a flow chart illustrating one embodiment of a gear analysis processing program for determining the gear burnishing parameters to be applied to a gear. FIG. 2B illustrates the detection of different magnitudes of nicks a, b, and c on a gear from the sensor output. The processing routine includes a counter 21 for setting the number of gears to be processed in a given run, a checking step 22 for receiving the output of the pre-checking station for a particular gear, a test step 23 to determine if the amplitude of the sensor output indicates a nick within a first (small) range a of nicks, a test step 24 for a second (medium) range b of nicks, and a test step 25 for a third (large) range c of nicks. If the nick is in a small range, the program outputs a minimum processing time Tmin and burnishing pressure Pmin to be used for the gear. If it is in the medium range, a medium processing time T1 and burnishing pressure P1 are output. If it is in the large range, a longer processing time T2 and higher burnishing pressure P2 are output for maximum removal of nicks and scales on the gear teeth. If the nick exceeds the maximum range, the gear is a 'total reject'. The program then indexes the count to the next gear, until the analyses of all gears are finished.

As an alternative to pre-set ranges, the gear analysis program can use a graduated assignment of gear burnishing times and pressures corresponding to the amplitude of the nick detected in the sensor output. This would require more sensitive controls to control the drive gear of the gear burnishing machine.

Figure 3:
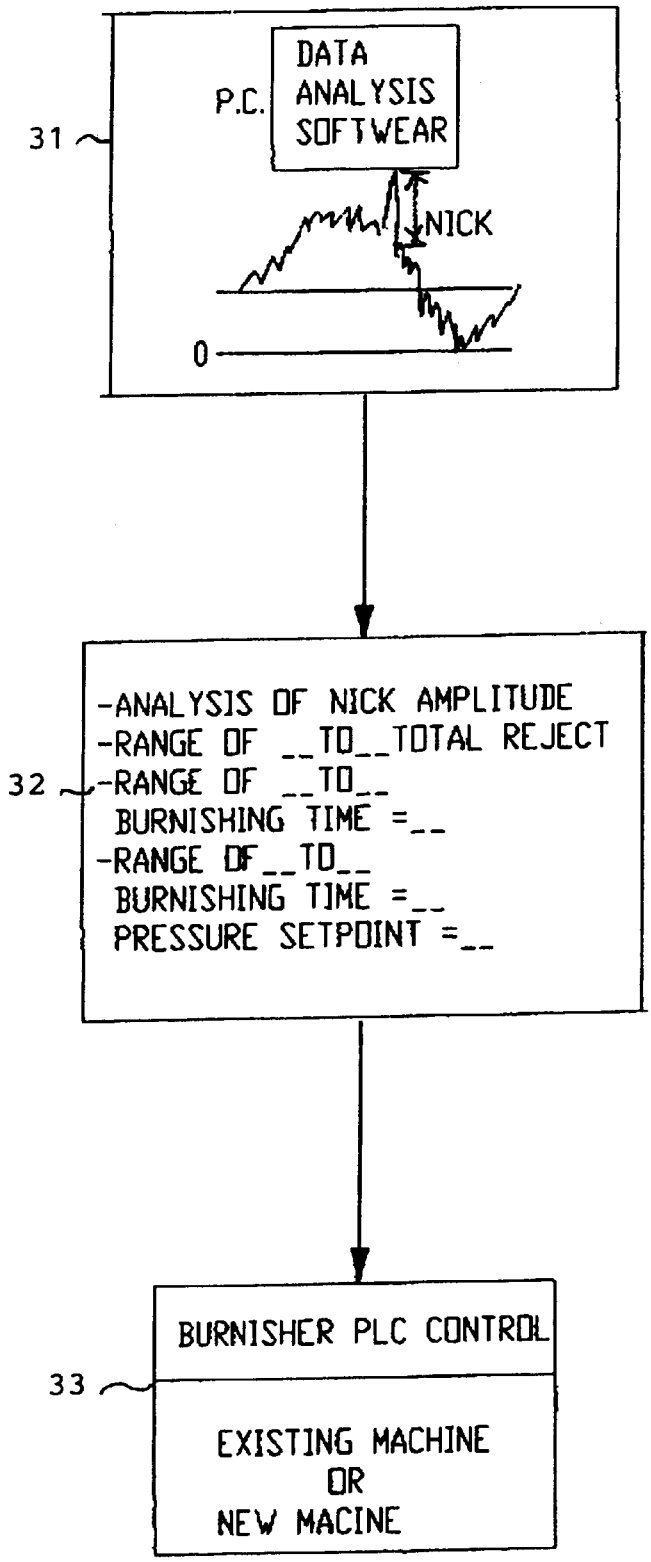
FIG. 3 is a schematic diagram illustrating the components of the system for controlling the gear burnishing station in accordance with the output of the pre-checking station.

FIG. 3 illustrates the components of the system for controlling the gear burnishing station in accordance with the output of the pre-checking station. This includes the above-described gear analysis program 31, which would typically be implemented as a software program run on a suitable processor, the resulting gear burnishing data indicated at 32, and the burnisher control 33 for controlling the burnishing station including the drive gear pressure P and time of operation T. The pre-checking station and control components can be retrofitted to an existing machine, or be assembled as components of a new gear burnishing machine.

The gear burnishing system of the present invention will save cycling time for burnishing gears, as well as wear and tear on the machine from unnecessary operation, thereby also extending its lifetime. If a gear has large nicks, the system adapts by performing the burnishing operation for a longer time and/or with greater pressure. Processed gears may be re-checked to determine if nicks still exist and require further processing. Since the system will set slower processing parameters if the nicks have now been reduced, unnecessary processing time and wear and tear is avoided even when taking a further processing step.

It is understood that many modifications and variations may be devised given the above description of the principles of the invention. It is intended that all such modifications and variations be considered as within the spirit and scope of this invention, as defined in the following claims.

I claim:

1. A gear burnishing system comprising:

(a) a pre-checking station for determining the condition of a gear to be burnished, and providing gear burnishing data representing an amount of burnishing processing needed by the gear in accordance with the determination of the pre-checking station;

(b) a gear burnishing station for receiving the gear and performing a burnishing operation thereon to remove nicks and restore it from deterioration, said gear burnishing station receiving the gear burnishing data and setting parameters for the burnishing operation in accordance therewith.

2. A gear burnishing system according to claim 1, wherein the pre-checking station determines the condition of the gear and outputs gear burnishing parameters in one of a plurality of pre-set ranges that the gear condition falls in.

3. A gear burnishing system according to claim 1, wherein the pre-checking station determines the condition of the gear and outputs a gear burnishing parameter of a length of time for the gear to be processed by the gear burnishing station.

4. A gear burnishing system according to claim 1, wherein the pre-checking station determines the condition of the gear and outputs a gear burnishing parameter of a burnishing pressure to be applied by the gear burnishing station.

5. A gear burnishing system according to claim 1, wherein the gear burnishing station includes a drive gear to be placed into engagement with the gear to be burnished, and a control component for controlling a length of time and a burnishing pressure for engagement of the drive gear with the gear to be burnished.

* * * * *